US007325896B2

(12) United States Patent
Koehler et al.

(10) Patent No.: US 7,325,896 B2
(45) Date of Patent: Feb. 5, 2008

(54) TEMPERATURE CALIBRATION FOR FLUID EJECTION HEAD

(75) Inventors: Duane A. Koehler, Vancouver, WA (US); Jefferson P. Ward, Brush Prairie, WA (US); Huston W. Rice, Vancouver, WA (US); Victorio A. Chavarria, Corvallis, OR (US); Kenneth D. Saul, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/448,971

(22) Filed: May 30, 2003

(65) Prior Publication Data

US 2004/0239711 A1 Dec. 2, 2004

(51) Int. Cl.
*B41J 29/38* (2006.01)

(52) U.S. Cl. ..... 347/17; 347/5; 347/19

(58) Field of Classification Search ..... 347/17, 347/5, 19

See application file for complete search history.

(56) References Cited

U.S. PATENT DOCUMENTS 5,576,745 A * 11/1996 Matsubara ..... 347/14
6,231,153 B1 * 5/2001 Elgee ..... 347/17
6,302,507 B1 * 10/2001 Prakash et al. ..... 347/14
6,644,774 B1 * 11/2003 Burger et al. ..... 347/19
2002/0140755 A1 * 10/2002 Hetzer et al. ..... 347/17
2003/0156182 A1 * 8/2003 Coons et al. ..... 347/189

FOREIGN PATENT DOCUMENTS

EP 1176016 A2 * 1/2002

* cited by examiner

*Primary Examiner*—Manish S. Shah
*Assistant Examiner*—Laura E. Martin

(57) ABSTRACT

The present invention includes as one embodiment a method of ejecting a fluid onto a print media. The method includes providing an ejection head having a nozzle that is coupled to a temperature sensor and a memory device. The method further includes measuring an uncalibrated temperature of the ejection head with the temperature sensor, recalling a correction value from the memory device, applying the correction value to the uncalibrated temperature to generate a calibrated temperature, and ejecting fluid from the nozzle onto the print media when the calibrated temperature is within a predefined temperature range.

19 Claims, 3 Drawing Sheets

TEMPERATURE CALIBRATION FOR FLUID EJECTION HEAD

BACKGROUND

Inkjet printheads are often supplied as a portion of an inkjet cartridge, which may be replaced when empty or beyond its service life. In a thermal fluid ejection system, a barrier layer containing ink channels and vaporization or firing chambers is located between a nozzle orifice plate and a substrate layer.

The substrate layer typically contains linear arrays of heater elements, such as firing resistors, which are energized to heat ink within the vaporization chambers. Upon heating, an ink droplet is ejected from a nozzle associated with the energized resistor. By selectively energizing the resistors as the printhead is moved across a page, ink is expelled in a pattern on the print media to form a desired image.

Careful regulation of the printhead temperature aids inkjet printing mechanisms in providing optimal print quality and reliability, while also extending printhead life. One method of monitoring printhead temperature uses a temperature sensing resister ("TSR"), which is embedded into the printhead during manufacture of the firing resistors.

However, in order to calibrate a printhead's TSR, an inkjet printer typically uses a separate ambient temperature sensor, which adds expense to the product and requires a complex calibration routine. This calibration system typically requires the printhead temperature to be brought to ambient temperature before start of a calibration routine, often requiring printers to be idle for nearly an hour before calibration. Furthermore, if a customer installs a new printhead and immediately begins printing with performing calibration, poor print quality or a shortening of the life of the printhead may result. For these and other reasons, there is a need for the present invention.

SUMMARY

The present invention includes as one embodiment a method of ejecting a fluid onto a print media. The method includes providing an ejection head having a nozzle that is coupled to a temperature sensor and a memory device. The method further includes measuring an uncalibrated temperature of the ejection head with the temperature sensor, recalling a correction value from the memory device, applying the correction value to the uncalibrated temperature to generate a calibrated temperature, and ejecting fluid from the nozzle onto the print media when the calibrated temperature is within a predefined temperature range.

BRIEF DESCRIPTION OF THE DRAWINGS

The embodiments of the present invention can be further understood by reference to the following description and attached drawings that illustrate. the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the preferred embodiments, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. Exemplary Thermal Fluid Ejection System

Figure 1:
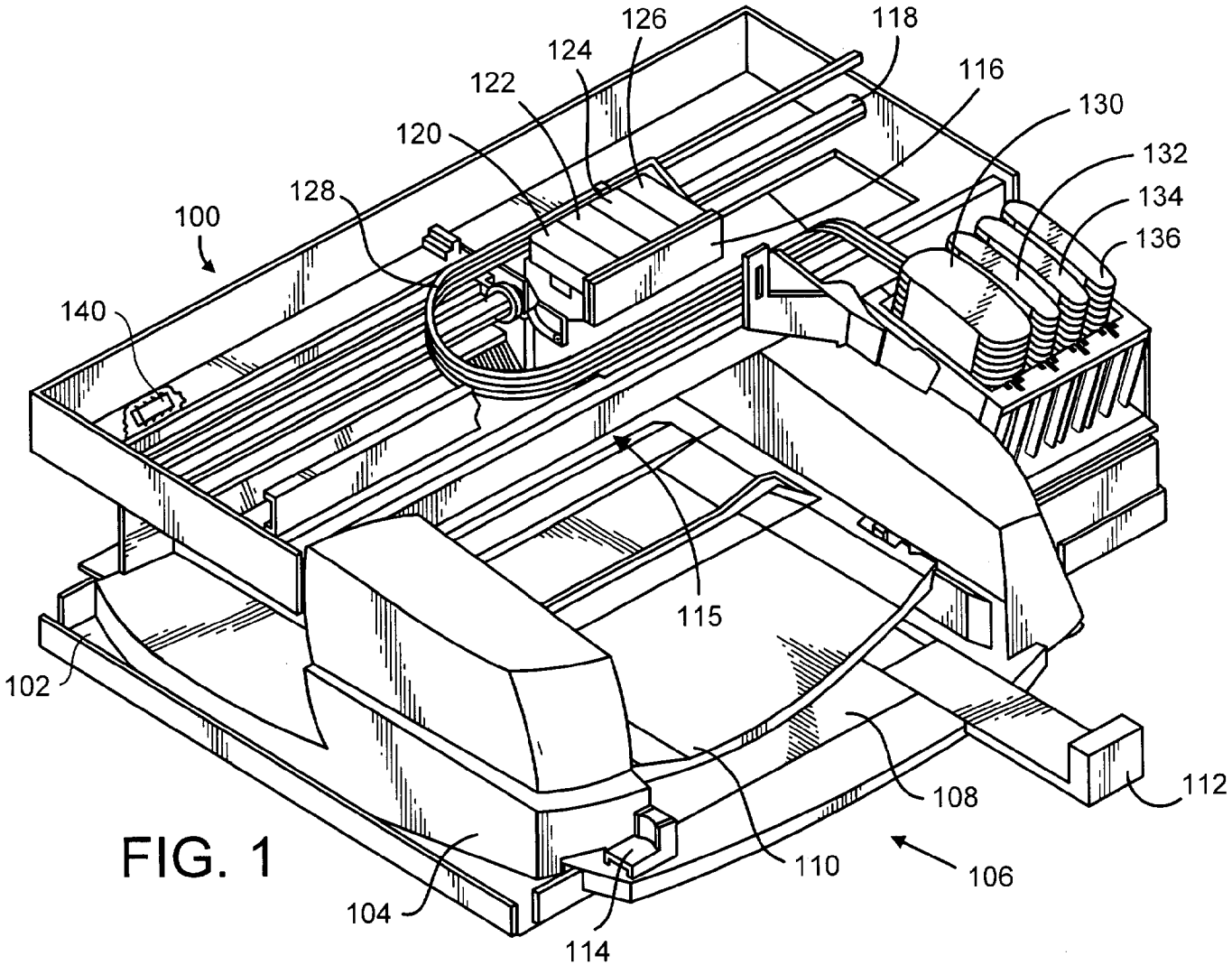
FIG. 1 is a perspective view of one embodiment of a thermal fluid ejection system, here shown as an inkjet printing mechanism.

FIG. 1 shows one embodiment of a thermal fluid ejection system, here illustrated for convenience as an inkjet printing mechanism 100 configured as a desktop inkjet printer. The printer 100 includes frame or chassis 102, and a casing or housing 104, a portion of which has been omitted to view the internal components of the printer.

The illustrated printer 100 includes a print media handling system 106 having an input tray 108 and an output tray 110. The input tray 108 may be equipped with various adjustment levers for accommodating different sizes of media, such as a length adjustment lever 112 and a width adjustment lever 114. Print media, for instance paper, is picked from the input tray 108 and may be fed around a series of conventional media drive rollers powered, for instance, by a stepper motor (not shown), and fed through a printzone 115 before being deposited in the output tray 110.

A printhead carriage 116 is supported for linear movement across the printzone 115 by a guide shaft 118. The carriage 116 supports one or more inkjet cartridges or pens, such as cartridges 120, 122, 124 and 126, dispensing black ink, cyan ink, yellow ink and magenta ink, respectively in the illustrated embodiment.

Each of the cartridges 120, 122, 124 and 126 has a small ink reservoir and receives additional ink through a flexible tubing or conduit assembly 128 from stationary, replaceable main reservoirs of ink 130, 132, 134 and 136, respectively. Inkjet printing mechanisms, as well as the more general class of the thermal fluid ejection systems, may take on a variety of different forms while still implementing the concepts described herein.

For instance, the illustrated ink delivery system of printer 100 is referred to as an off-axis system because the main reservoirs of ink are stored in the location away from the reciprocating cartridges 120-128. In contrast, another system, commonly referred to as an "on-axis" system, has cartridges that carry their entire ink supply across the printzone 115.

One form of an on-axis system uses replaceable cartridges where both the ink ejecting printhead and the ink reservoir are supplied as a unit and replaced when the cartridge is empty. Another form of an on-axis system is known in the industry as a "snapper." In a snapper system, the printheads are permanently or semi-permanently mounted to the printhead carriage, and the ink supply is a separate unit that is snapped onto the printhead. Still another form of printing system uses a page wide array of printheads, where stationary nozzles extend across the entire length of printzone 115. These are several of the most popular types of ink delivery systems currently available, although it is apparent that other thermal fluid delivery systems may be suitable in other implementations.

The inkjet printer 100 also includes a controller 140, shown schematically in FIG. 1, which communicates information between a user interface, such as a personal computer (not shown), and the cartridges 120-126. Optionally, the printer 100 may include a keypad (not shown) or other user input interface, also in communication with the controller 140.

The controller 140 may be implemented as firmware and/or hardware incorporated into the printer as a master controller device, or implemented by a printer driver as software operating on a computer system (not shown) that is connected to controller 140. As used herein, the concept of printer controller incorporates these various combinations of control elements, whether performed within the printer, within a remote computer, or within a combination of both.

II. Exemplary Fluid Ejection Cartridge

Figure 2:
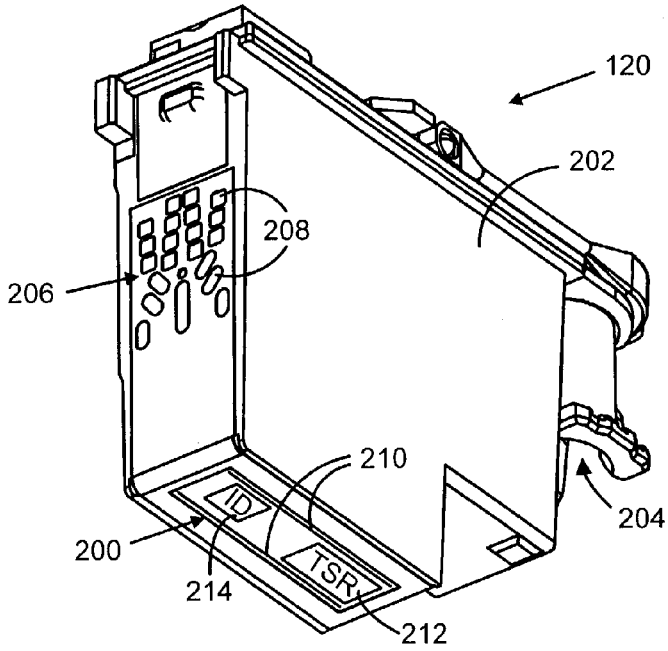
FIG. 2 is a perspective, partially fragmented, and schematic view of one embodiment of a thermal fluid ejection cartridge, here shown as an inkjet cartridge having an inkjet printhead suitable for use with the inkjet printing mechanism of FIG. 1.

FIG. 2 is an exemplary embodiment of a thermal fluid ejection cartridge, here illustrated as the black ink ejecting cartridge 120 of FIG. 1. The cartridge 120 includes a fluid ejector or printhead 200 supported by a body 202, which has a hollow interior defining a reservoir for carrying a fluid supply of black inkjet ink.

As mentioned above with respect to FIG. 1, the onboard ink supply of cartridge 120 is replenished through the ink delivery conduit or tubing system 128 from the main ink reservoir 130, through an ink interface 204. The cartridge 120 has an electrical interconnect 206 with a series of electrical contact pads 208 which are used to communicate information between the cartridge 120 and the printer controller 40. The printhead 200 includes one or more groups of ink ejecting orifices or nozzles, here illustrated as being arranged in two substantially linear nozzle arrays 210. In practice, the nozzles within each array 210 may be slightly staggered or offset from one another, and indeed other arrangements of nozzles may also be used in other implementations.

In one embodiment, for improved print quality and reliability, the temperature of printhead 200 is regulated by the printer controller 140. To accomplish this temperature regulation, the printhead 200 also includes one or more temperature sensing elements, such as a temperature sensing resistor ("TSR") 212 embedded within the printhead silicon and illustrated schematically in FIG. 2.

The temperature of the printhead 200 may be monitored by periodically measuring the resistance of TSR 212 to ensure that the printhead stays within an acceptable operating range. The cartridge 120 also includes a processing or memory unit, such as an integrated circuit chip 214, which may store a variety of information about the cartridge, such as identifying ("ID") information in an ID register.

The exact location of the memory unit 214 may vary with various cartridge designs, and indeed, it may be more suitably located adjacent to the electrical interface 206 or supplied therewith, or embedded within the printhead silicon along with TSR 212. For example, in the illustrated print cartridge 120, the ID register 214 is supplied as an integral part of the printhead silicon. The ID register 214 may be implemented as a series of fuses that may be programmed (or "blown") during the manufacturing process, and may be read by the printer controller 140.

The illustrated TSR 212 has a resistance that changes in proportion to temperature, yielding a resistance vs. temperature curve having a slope that is known and constant for the particular type of TSR used. Indeed, the slope of this TSR resistance vs. temperature curve does not very significantly with semiconductor manufacturing process variations, although the resistance value at a given reference point, for instance 25° C., known as an "offset value," can change significantly from unit to unit as a result of process drift.

The term "process drift" refers to the variation in the TSR's physical length and width. Any physical dimension on the silicon die depends upon the tolerances of certain manufacturing processes, such as photolithography, etch-back, impurities of materials, and local defects in the silicon. The nominal value of the TSR is a function of both its physical length and width, so variations in either of these dimensions will result in variations in resistance. In order to reduce the temperature measurement error to an acceptable and useful level, this offset value must be calibrated out of the temperature measurements made by TSR 212.

Figure 3:
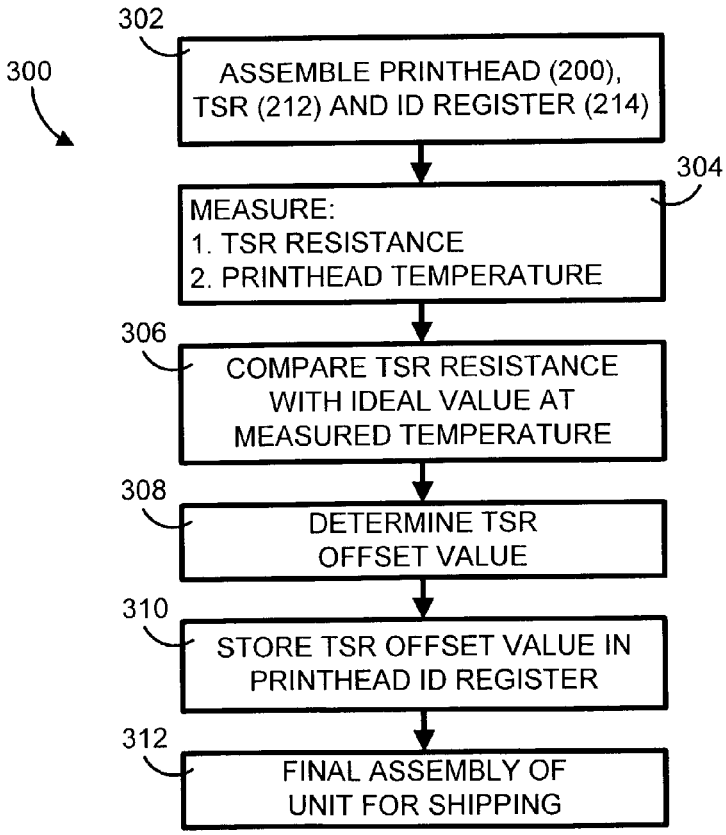
FIG. 3 is a flowchart showing one embodiment of a method of manufacturing the cartridge of FIG. 2.

III. Exemplary Method of Manufacturing a Fluid Ejection Cartridge of the Fluid Ejection FIG. 3 shows one embodiment of a method 300 of manufacturing inkjet cartridge 120, and/or printhead 200. Recall that while printhead 200 is shown as integral portion of the replaceable cartridge 120, in other inkjet printing systems using permanent or semi-permanent printheads, such as a page wide array printing system or a snapper ink delivery system, the ink supply may be detachable from the printhead.

In such a detachable printhead system, the processor or memory unit 214 typically resides with the fluid ejection head, rather than with the replaceable reservoir. In either case, when installed within a fluid ejection system such as printer 100, the memory unit 214 is placed in communication with controller 140. As a first portion of method 300, in an assembly operation 302, the printhead 200, TSR 212, and the processor or memory unit, here illustrated as an ID register 214, are assembled.

Following assembly 302, in measuring action 304, the TSR resistance is measured, typically with a precision ohmmeter, and at substantially the same time, the printhead temperature is also measured. In a comparing action 306, the measured TSR resistance is compared with an ideal value at the measured printhead temperature. Preferably, this ideal value is set to the process distribution mean of the resistance. The process distribution mean is an average value for printheads manufactured using a particular process or for printheads manufactured in a particular batch.

Following the comparing action 306, in a determining operation 308, a TSR offset value is determined and then stored in the printhead ID register 214 in a storing action 310. In some embodiments, the offset value which is stored within the ID register 214 may be a value that is proportional to the difference between the precision ohmmeter reading of the measuring action 304 and the expected value, which is generally the process mean or average value for printheads being manufactured in a particular batch or according to a particular process. For instance, this proportional value may be expressed as:

$$TSR_offset = TSR_measured - TSR_expected_mean$$

For example, assume that the printhead manufacturing process produced a TSR with a mean value of 100 Ohms. If a particular printhead was measured and found to have a TSR resistance of 120 Ohms, then a value of 20 Ohms would be stored in the ID register. This value may be encoded using a binary weighting scheme to maximize resolution with a limited number of ID bits. It would be helpful to know the minimum and maximum values that may be expected over the process, so that the entire range of possible values could be encoded.

For instance, if the process had a +/−20 Ohm variance, then values of −20 to +20 would need to be encoded. If the ID register had 8 bits of resolution (8 fuses), and one sign bit was used to indicate polarity, then the resolution would be:

$$LSB = \frac{20 \text{ Ohms}}{2^7} = \frac{20}{128} = 0.156 \text{ Ohms}$$

As such, a range of 80 to 120 Ohms may be encoded in the illustrated 8-bit ID register 214. When the printhead is installed within a fluid ejection system such as printer 100, the value of the printhead's TSR could be determined within +/−1 bit, or +/−0.156 Ohms. It is apparent that this scheme may use more bits to increase measurement resolution, or fewer bits in some implementations.

In other embodiments, instead of storing the offset value, the actual measured value may be encoded. Other types of a derived correction value may be used by the printer 100 to calibrate the printhead's TSR measurement. Thus, with the illustrated embodiment is described in terms of an offset value, the term "correction value" has a broader scope, and includes the offset value, the actual measured value, and other derivations of correction values.

Following the storing 310 is a final assembly of the unit for shipping in a final assembling action 312. Note that this final step 312 refers to assembly of the "unit," which may be either a permanent or semi-permanent printhead unit for use with a detachable ink reservoir, or the unit may be an inkjet cartridge, such as cartridge 120, as well as other variations of a fluid dispensing cartridge.

IV. Exemplary Method of Thermal Fluid Ejection

Figure 4:
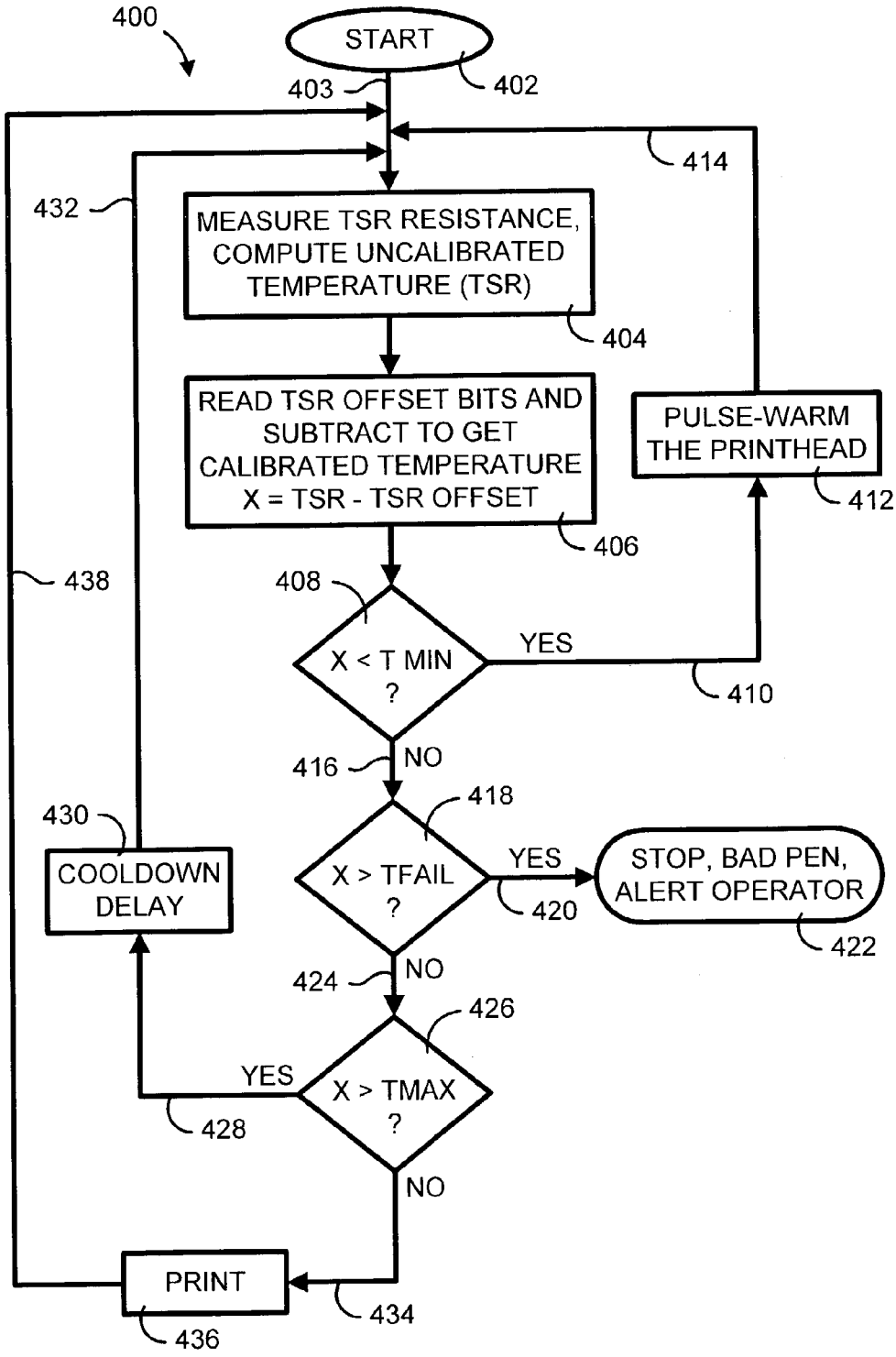
FIG. 4 is a flowchart showing one embodiment of a method of calibrating the cartridge of FIG. 2 for use in printing.

FIG. 4 shows one embodiment of a thermal fluid ejection method, here illustrated as an inkjet printing method 400 that uses the stored TSR offset value to normalize the resistance vs. temperature relationship that the printer controller 140 uses to maintain proper printhead temperature.

First, in an initiating or starting action 402, a start signal 403 is generated. This start operation 402 may be commenced after a variety of different events, for instance, after installation of a new printhead 200, after powering up on the printer 100 after a period of inactivity, daily or at other fixed intervals, or upon initiation of a new print job.

After receiving the start signal 403, the measuring and computation operation 404 is performed, where the resistance of the TSR 212 is measured and from this resistance measurement, an uncalibrated temperature value is computed, for instance by controller 140. In a calibrating operation 406, first the TSR offset value (TSR OFFSET) stored in the ID register 214 is read and subtracted from the uncalibrated TSR temperature (TSR) computed in action 404, to arrive at a calibrated temperature X, as indicated in FIG. 4 by the equation:

$$X = \text{TSR} - \text{TSR OFFSET}$$

Several checks are then made to determine if the calibrated temperature X is within acceptable limits for printing.

In a first comparing action 408, the calibrated temperature X is checked to see if it is at a minimum level for printing, as indicated by the equation: X<TMIN? If the calibrated temperature X is below the minimum value required for printing, a YES signal 410 is issued to a warming routine 412, where a pulse warming operation is performed on the printhead 200. Pulse warming is just one type of warming operation used in the illustrated embodiment, and it is apparent that other types of warming routines may be performed, for instance block warming, to bring the printhead temperature up to at least TMIN for printing.

Following completion of the warming routine 412, a signal 414 is issued to again generate the start signal 403, which followed by repetition of steps 404, 406 and 408. The pulse warming routine 412 may be repeated until the comparing step 408 determines the calibrated temperature acts is at or above the minimum temperature level TMIN, and a NO signal 416 is issued to a second comparing operation 418.

In the second comparing action 418, the calibrated temperature X is checked to see whether it is above a failure temperature TFAIL, as indicated by the equation: X>TFAIL? If the calibrated temperature X is above the failure temperature, a YES signal 420 is issued to an operator alerting action 422. This operator alerting step 422 may be a flashing light on the housing 104 of printer 100, or an error message delivered by the controller 140 to a computer system or other operator interface indicating that the cartridge is bad, or if using a snapper system or an off-axis system, that the permanent or semi-permanent printhead needs replacement. After replacing either the bad cartridge or bad printhead, the starting step 402 is initialized and method 400 continues with the new cartridge or printhead. If the calibrated temperature X is not above the failure temperature TFAIL, then a NO signal 424 is issued to a third comparing operation 426.

In the third comparing action 426, the calibrated temperature X is compared with a maximum operating temperature TMAX, as indicated by the equation: X>TMAX? If the calibrated temperature X is above a maximum operating temperature, a yes signal 428 is issued to a cooldown delay routine 430.

A cooldown delay routine 430 delays the printing operation for a selected amount of time, which for instance may be a standard interval, or an interval which changes depending upon the value of the calibrated temperature X, or a value which varies with the number of times the YES signal 428 has been issued for a particular printhead. A cooldown time delay is just one type of cooling operation usable with the present invention; for example, in other embodiments the operation of a cooling fan or other cooling device may be initiated or accelerated in response to signal 428.

Following completion of the cooldown delay routine 430, a signal 432 is issued to again initiate the start signal 403, followed by repetition of steps 404, 406, 408, 418, and 426. When the third comparing step 426 determines that the calibrated temperature X is at or below the maximum operating temperature TMAX, a NO signal 434 is issued.

After receiving the NO signal 434, a printing operation 436 is then conducted by ejecting ink on print media. Following completion of the printing operation 436, a signal 438 is generated to initiate the start signal 403. As mentioned above, signal 438 may be generated not only upon completion of an entire print job, but in some embodiments at the end of printing each page.

As another example, in situations where relatively heavy ink saturation has been required to print a page, for instance when printing photographic images or color charts rather than text, it may be desirable to initiate signal 438 to check the printhead temperature in step 426 and determine whether the cooldown delay routine 430 needs to be performed mid-page. Also, in some embodiments the cooldown delay may include substituting nozzles from a different, cooler printhead in order to speed up printing by reducing the delay time.

V. CONCLUSION

Thus, using the methods described herein to construct a fluid ejection head, such as printhead 200, whether permanently attached to an ink supply as a cartridge, for instance cartridge 120, or whether constructed as a permanent or semi-permanent printhead, for instance in a snapper system, optimal fluid ejection quality and performance is provided to the customer.

In the context of inkjet printing, this results in optimal print quality being available at all times, without encountering any cooldown calibration delay after installation of a new printhead. In contrast, earlier systems that used separate ambient temperature sensors within a printer experienced cooldown calibration delays. These delays were typically caused by having the printhead temperature be brought down to ambient temperature before the start of a calibration routine. In these systems, often the printer would be idle for nearly an hour before calibration was completed. However, the printer 100 of the present invention does not have these cooldown calibration delays, which results in a printer that may be a more compact, economical unit, since a separate ambient temperature sensor is no longer required.

Further, using the methods and the printhead system described herein, printhead life is prolonged by avoiding the firing of the printhead at any temperature over the maximum operating temperature limit. Additionally, printer life is prolonged by the early detection of an overheating cartridge, and by providing an immediate alert to the operator that the malfunctioning cartridge needs to be replaced.

All of the illustrated methods and printheads have been described herein in the context of a thermal fluid ejection system, but these principles may also be applied in other fluid ejection systems, for instance, in a piezo-electric fluid ejection system, if printhead temperature is an issue needing accurate monitoring. Further, while the illustrated embodiment has been described with respect to inkjet printing, these inventive concepts may have much broader application, for instance, in the application on the medications to a patient, as well as other contexts where precise amounts of fluid are ejected onto a target surface.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

The invention claimed is:

1. A method of ejecting a fluid onto a print media, comprising:

determining a correction value for a temperature sensor of an ejection head by measuring a resistance with a temperature sensing resistor of the ejection head and comparing the measured resistance with an ideal resistance measured by a precision ohmeter;

storing the correction value in a memory device;

measuring an uncalibrated temperature of an ejection head with the temperature sensor;

recalling the correction value from the memory device;

applying the correction value to the uncalibrated temperature to generate a calibrated temperature; and ejecting fluid from a nozzle of the ejection head onto the print media when the calibrated temperature is within a predefined temperature range.

2. The method of claim 1, further comprising:

determining whether the calibrated temperature is below a minimum operational temperature; and warming the ejection head when the calibrated temperature is below the minimum operational temperature.

3. The method of claim 2, wherein the warming comprises pulse warming the ejection head.

4. The method of claim 1, further comprising:

determining whether the calibrated temperature is above a failure temperature limit; and alerting an operator that the ejection head needs replacement when the calibrated temperature is above the failure temperature limit.

5. The method of claim 1, further comprising:

determining whether the calibrated temperature is above a maximum operational temperature; and performing a cooldown routine to cool the ejection head prior to ejecting fluid from the nozzle when the calibrated temperature is above the maximum operation temperature.

6. The method of claim 5, wherein the cooldown routine includes a time delay.

7. The method of claim 1, wherein ejecting fluid from the nozzle onto the print media comprises ejecting fluid from the nozzle when the calibrated temperature is above a minimum operational temperature, below a failure temperature limit, and below a maximum operational temperature.

8. The method of claim 1, wherein the ejection head comprises a thermal ejection head with an integrated temperature sensor comprising a temperature sensing resistor and with an integrated memory device comprising a register which also stores other information.

9. The method of claim 8, wherein the fluid comprises an inkjet ink, the ejection head comprises a thermal inkjet printhead, the other information comprises printhead identifying information, ejecting fluid from the nozzle onto the print media comprises ejecting the inkjet ink from the printhead nozzle in a printing operation.

10. A fluid ejection mechanism, comprising:

means for storing a correction value for a temperature sensor of an ejection head that has been determined by measuring a resistance with a temperature sensing resistor of the ejection head and comparing the measured resistance with an ideal resistance measured by a precision ohmeter;

means for measuring an uncalibrated temperature of an ejection head coupled to the temperature sensor;

means for recalling the correction value from the means for storing;

means for applying the correction value to the uncalibrated temperature to generate a calibrated temperature; and means for ejecting ink from the nozzle.

11. The fluid ejection mechanism of claim 10, further comprising means for determining whether the calibrated temperature is below a minimum operational temperature and means for warming the ejection head when the calibrated temperature is below the minimum operational temperature.

12. The fluid ejection mechanism of claim 11, wherein the means for warming comprises pulse warming the ejection head.

13. The fluid ejection mechanism of claim 10, further comprising means for determining whether the calibrated temperature is above a failure temperature limit and means for alerting an operator that the ejection head needs replacement when the calibrated temperature is above the failure temperature limit.

14. The method of claim 1, wherein determining a correction value comprises measuring a resistance with the temperature sensing resistor of the ejection head and comparing the measured resistance with an ideal resistance that comprises a process distribution mean of resistances measured by the precision ohmeter.

15. The method of claim 1, wherein the action of determining a correction value is performed during an assembly operation for a device that incorporates the ejection head.

16. The method of claim 1, wherein storing the correction value in a memory device comprises storing the correction value in a memory unit provided on the ejection head and wherein recalling the correction value comprises recalling the correction value from the ejection head memory unit.

17. The method of claim 1, wherein determining a correction value comprises determining an offset value that represents a difference between a value measured by the temperature sensor and an ideal value measured by the ohmeter and wherein applying the correction value comprises adding the offset value to a later value measured by the temperature sensor or subtracting the offset value from the later value measured by the temperature sensor.

18. A fluid ejection mechanism comprising:

a body that defines an ink reservoir; and a printhead provided on the body, the printhead including:

ejection nozzles configured to eject ink from the printhead, a temperature sensing resistor configured to measure a resistance of the printhead indicative of a temperature of the printhead, and a memory unit that stores a correction value for the temperature sensing resistor that has been determined by measuring a resistance with the temperature sensing resistor of the printhead and comparing the measured resistance with an ideal resistance measured by a precision ohmeter.

19. The fluid ejection mechanism of claim 18, wherein the memory unit stores an offset value that represents a difference between the resistance measured by the temperature sensing resistor and an ideal resistance measured by the ohmeter, wherein the offset value is either added to or subtracted from a later value measured by the temperature sensor to obtain a calibrated temperature.

* * * * *

UNITED STATES PATENT AND TRADEMARK OFFICE

CERTIFICATE OF CORRECTION

PATENT NO. : 7,325,896 B2
APPLICATION NO. : 10/448971
DATED : February 5, 2008
INVENTOR(S) : Duane A. Koehler et al.

It is certified that error appears in the above-identified patent and that said Letters Patent is hereby corrected as shown below:

In column 3, lines 35-36, delete "controller 40" and insert -- controller 140 --, therefor.

Signed and Sealed this

Tenth Day of June, 2008

JON W. DUDAS
*Director of the United States Patent and Trademark Office*